US006928937B2

(12) United States Patent
Booher

(10) Patent No.: US 6,928,937 B2
(45) Date of Patent: Aug. 16, 2005

(54) SOOTBLOWING CONTROL BASED ON BOILER THERMAL EFFICIENCY OPTIMIZATION

(75) Inventor: Joel H. Booher, Canal Winchester, OH (US)

(73) Assignee: Diamond Power International, Inc., Lancaster, OH (US)

( * ) Notice: Subject to any disclaimer, the term of this patent is extended or adjusted under 35 U.S.C. 154(b) by 0 days.

(21) Appl. No.: 10/739,858

(22) Filed: Dec. 18, 2003

(65) Prior Publication Data

US 2004/0159270 A1 Aug. 19, 2004

Related U.S. Application Data

(60) Provisional application No. 60/436,519, filed on Dec. 26, 2002.

(51) Int. Cl.[7] ..... F23B 7/00

(52) U.S. Cl. ..... 110/348; 110/341; 110/343

(58) Field of Search ..... 110/341, 348, 110/185, 186, 188, 190; 122/379, 390, 392

(56) References Cited

U.S. PATENT DOCUMENTS

| | | | | |
|---|---|---|---|---|
| 3,163,154 A | | 12/1964 | Cantieri et al. | |
| 3,257,993 A | * | 6/1966 | Kochey, Jr. | 122/392 |
| 3,276,437 A | * | 10/1966 | Jonachin et al. | 122/392 |
| 4,085,438 A | | 4/1978 | Butler | |
| 4,539,840 A | | 9/1985 | Klatt et al. | |
| 4,718,376 A | | 1/1988 | Leroueil et al. | |
| 4,996,951 A | | 3/1991 | Archer et al. | |
| 5,096,502 A | | 3/1992 | Carter et al. | |
| 5,181,482 A | | 1/1993 | Labbe et al. | |

OTHER PUBLICATIONS

LeVert, et al., "A Slag Deposition Monitor For Use in Coal–Fired Boilers", Sensors Expo Proceedings, 1986.

LeVert, et al., "Slag Deposition Monitor For Boiler Performance Enhancement", ISA Proceedings, 1987, Paper #87–1048.

Frank, et al., "The Effects of Soot Blowing On Boiler Tube Thermal Stress", American Power Conference, 1988.

Alder, et al., "Optimization of Automated Sootblowing Through On–Line Boiler Heat Balance Modeling", Power-Gen Conference, 1991.

Cortez, et al., "Thermal Modeling of Absorbed Heat Flux Meters in the Furnace Walls of a Coal Fire Utility Boiler", pp. 39–46.

Farrell, et al., "On–Line Monitoring of Furnace Wall and Superheater Corrosion in Power Generation Boilers", 39$^{th}$ Corrosion Science Symjposium, U.K., 1998.

Farrell, et al., "Performance Mapping of Industrial Plants Using an Electrical Resistance and Thermal Scanner", Euro-Corr 2000 Conference, London, U.K., 2000.

Energy Technologies, Inc., Knoxville, TN.; "Boiler Sensors: Increasing Boiler Efficiency", pp. 1–7.

Batelle, Columbus, OH; CEGB, Nottingham, England; "Slag Monitoring For Utility Boilers", CS–5692 EPRI Research Project 1893–5, Apr., 1988.

Freels et al., "On–Line Controllable Parameters Monitoring For Heat Rate Improvement," Richmond, Virginia (May 11, 1988).

* cited by examiner

*Primary Examiner*—Kenneth Rinehart
(74) *Attorney, Agent, or Firm*—Brinks Hofer Gilson & Lione

(57) ABSTRACT

The present invention provides a process for the control of a cleaning system for a boiler which incorporates factors related to the overall operation and efficiency of the boiler. Current values of plant data parameters associated with the boiler furnace are compared with respective setpoint values. The process then determines if the furnace is to be cleaned based on this comparison.

8 Claims, 2 Drawing Sheets

| | UNIT | READING | WEIGHT FACTOR | SETPOINT | PERMISSIVE |
|---|---|---|---|---|---|
| **HEAT RATE PERMISSIVE PARAMETERS** | | | | | |
| NORTH MAIN STEAM TEMPERATURE | °F | 996.2 | | | |
| SOUTH MAIN STEAM TEMPERATURE | °F | 998.1 | | | |
| AVERAGE | °F | **997.2** | 1.4 | 995 | 3.1 |
| NORTH REHEAT STEAM TEMPERATURE | °F | 989.8 | | | |
| SOUTH REHEAT STEAM TEMPERATURE | °F | 970.9 | | | |
| AVERAGE | °F | **980.3** | 1.4 | 995 | -20.5 |
| NORTH SUPERHEAT SPRAY FLOW | Klb/hr | 127.4 | | | |
| SOUTH SUPERHEAT SPRAY FLOW | Klb/hr | 109.6 | | | |
| TOTAL SUPERHEAT SPRAY FLOW | Klb/hr | **237.1** | 0.246 | 10 | 55.9 |
| REHEAT SPRAY FLOW | Klb/hr | **36.1** | 2.15 | 10 | 56.2 |
| OVERALL HEAT RATE CHECK | | | | | **94.6** |
| OVERALL HEAT RATE PERMISSIVE | | | | | **1** |
| | | | | | |
| **OPERATIONAL PERMISSIVE PARAMETERS** | | | | | |
| LOAD | MW | **589.2** | >X | 300 | 1 |
| LEFT FEGT | °F | **2362** | >X | 2200 | 1 |
| RIGHT FEGT | °F | **2295** | >X | 2200 | 1 |
| | | | | | |
| **OVERALL SYSTEM PERMISSIVE** | | | | | **1** |

Fig. 2

SOOTBLOWING CONTROL BASED ON BOILER THERMAL EFFICIENCY OPTIMIZATION

RELATED APPLICATION

The application claims the benefit of the filing date under 35 U.S.C. §119(e) of Provisional U.S. patent application Ser. No. 60/436,519, filed Dec. 26, 2002, which is hereby incorporated by reference.

BACKGROUND

This invention relates to a system for controlling cleaning equipment of a large scale boiler or other combustion device.

In the operation of large scale combustion devices, such as utility boilers, combustion products cause slag and ash encrustations to build on heat transfer surfaces, degrading the thermal performance of the system. In order to restore the thermal performance, various systems for cleaning the internal heat transfer surfaces are presently in use.

One type of cleaning system is referred to in the industry as sootblowers. Sootblowers are used to project a stream of a blowing medium, such as steam, air, or water, against heat exchanger surfaces within the combustion device. One type of sootblower is known as a long retracting type and incorporates a lance tube, which is periodically inserted into and withdrawn from the interior of the boiler. Nozzles at the distal end of the lance tube project a stream of the cleaning medium against the desired surfaces within the boiler.

Wall blower units are mounted to the outside wall of the boiler and project a stream of cleaning fluid through a wall port against surfaces within the boiler. Some of these devices use a lance which is not inserted into the boiler and is capable of articulating to aim its stream of fluid in a desired manner within the boiler interior.

Irrespective of the cleaning mechanisms used, it is necessary to control their operation so that they are not operated needlessly. The introduction of the steam, air, or water into the boiler for cleaning often has undesirable thermal efficiency effects. Moreover, their use for surfaces which do not need to be cleaned can cause physical damage to these interior boiler components. Accordingly, some mechanism is necessary to control the operation of boiler cleaning devices. A boiler may have dozens or more individually controlled sootblowers or other cleaning devices.

It is known to use various boiler operating parameters to activate the cleaning cycles of the boiler cleaning systems. One approach uses infrared cameras which evaluate the internal surfaces of the boiler. Since the walls which are coated with ash have a different reflectivity factor than other surfaces, this difference may be used as a means of measuring the development of slag and ash encrustations as an input for initiating a cleaning cycle. Heat flux sensors are also used which are placed within the heat transfer surfaces of the boiler and evaluate the difference in temperature between the wall surface and the process heat transfer fluid (typically water). A degradation in heat transfer is measurable as a difference in the temperature reading from these two thermocouples. Again, this output may be used as part of a boiler cleaning control system.

Boiler cleaning may also be initiated on a timed cycle, based on certain assumptions regarding the development of slag and ash encrustations over time.

Boiler cleaning systems which base their control decisions on the characteristics of selective surfaces do not comprehend the full impact of cleaning operation on the boiler plant operation.

From the above, it is seen that there exists a need for a cleaning system that controls the timing of the cleaning process to optimize the overall boiler efficiency.

SUMMARY OF THE INVENTION

In overcoming the above mentioned and other drawbacks, the cleaning system in accordance with the present invention provides a methodology for the control of the cleaning system for a boiler which incorporates factors related to the overall operation and efficiency of the boiler. The operation of the system in accordance with this invention is expected to result in cleaning operations being delayed, even where surfaces to be cleaned are ordinarily considered in need of cleaning.

In some implementations, the method includes receiving plant data of parameters associated with the furnace and comparing current values of the parameters with setpoint values. The method then determines whether to clean the furnace based on the comparison between the current values and setpoint values of the parameters.

When comparing the current values to the setpoint values of the parameters, the method may consider how the deviation of the current values from the setpoint values affects the thermal efficiency of the steam cycle of the furnace.

The comparison between the current values and the respective setpoint values may include determining the difference between the current values and the respective setpoint values. The product of the difference and a corresponding weight factor may provide a respective permissive value.

In certain implementations, a positive permissive value indicates cleaning the furnace would increase the efficiency of the thermal cycle, and a negative permissive value indicates cleaning the furnace would decrease the efficiency of the thermal cycle. In particular implementations, upon adding the permissive values, a positive sum indicates that the furnace is to be cleaned.

The parameters considered may include the superheat steam temperature and the reheat steam temperature. Other parameters considered may include the amount of attemperation spray flow being injected into the main steam and the reheat steam to control the superheat steam temperature and the reheat temperature.

Further advantages and features of the invention will become apparent from the following detailed description and from the claims.

BRIEF DESCRIPTION OF THE DRAWINGS

The accompanying drawings, incorporated in and forming a part of the specification, illustrate several aspects of the present invention and, together with the description, serve to explain the principles of the invention. The components in the figures are not necessarily to scale, emphasis instead being placed upon illustrating the principles of the invention. Moreover, in the figures, like reference numerals designate corresponding parts throughout the views. In the drawings:

FIG. 2 depicts a page of a spreadsheet analysis of key parameters associated with the cleaning of a furnace in accordance with the process shown in FIG. 1.

DETAILED DESCRIPTION

Figure 1:
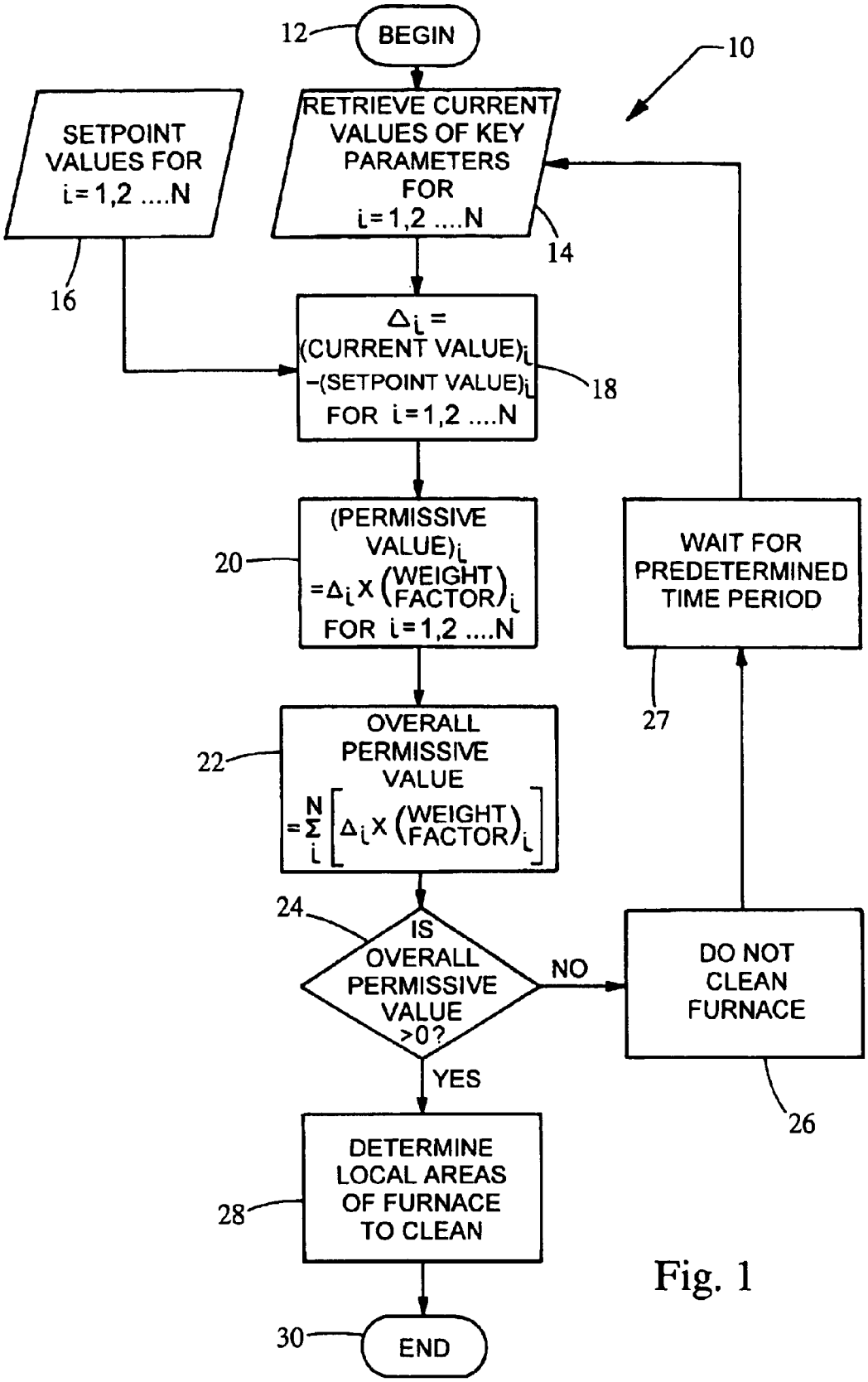
FIG. 1 is a flow diagram of a sequence of steps for determining whether or not to clean a boiler in accordance with the invention.

The cleaning system utilizing this invention takes in current values of plant data and makes a decision about whether to clean the furnace at all, as well as which local areas in the furnace should be cleaned. The general decision on whether to clean is based on a comparison of the current value of key parameters of the plant data to their setpoint values, including, in some implantations, cleanliness measures. The key parameters selected for analysis are those which furnace cleaning will affect, including the main superheat steam temperature, the hot reheat temperature, and the amount of attemperation spray flow being injected to control these temperatures. In the comparison of the current values of the parameters to their setpoint values, the system of the present invention considers how this deviation affects the thermal efficiency of the steam cycle (i.e. the "heat rate" of the plant).

For a typical electric generating boiler utilizing a steam drum and operating at pressures below the critical point, cleaning the furnace reduces the gas temperature leaving the furnace and entering the superheat and reheat sections. Therefore, as the furnace is cleaned, there will be less heat transfer in the superheat and reheat sections. In some cases, this reduction in heat transfer is a positive factor for the thermodynamic balance of the boiler, while in some cases, it is actually a negative factor. In the negative instance, if either the superheat or reheat temperature is below design specifications, furnace cleaning would further reduce the temperature, hurting the efficiency of the boiler.

In other cases, the uncontrolled superheat or reheat temperature may be above design specifications. In such cases, plant components exposed to these high temperatures may be damaged. Therefore, attemperator spray flow is typically injected into the superheater or reheater to lower the respective steam temperatures. Steam attemperation spray flow, however, has an undesirable effect on boiler efficiency, especially when injected in the reheater. Therefore, the ideal condition is for the boiler to achieve its design steam temperatures with little or no attemperator spray flow. If attemperator spray flow is occurring and it is successful in holding the temperature at the correct level through flow modulation, then furnace cleaning will reduce the amount of attemperation spray flow since the furnace cleaning will lower the steam temperature in place of the attemperation spray flow.

Referring now to FIG. 1, there is shown, in accordance with the invention, a process 10 for determining when to clean a furnace to optimize its performance. After the process 10 initiates in step 12, step 14 receives current values of the aforementioned key parameters (i.e. for i=1, 2, . . . N, where i identifies a key parameter, such as the superheat steam temperature, the reheat steam temperature, and the respective attemperation spray flow rates). Meanwhile, block 16 provides the respective setpoint values of these parameters. The setpoint values are typically the design values at which the plant operates most efficiently. An operator can also select the setpoint values, for example, through a computer interface.

The process 10 then proceeds to step 18 which determines the difference ($\Delta_i$) between the current value and the setpoint value of each parameter. Subsequently, step 20 multiples the difference ($\Delta_i$) with a respective weighting factor to determine a permissive value for each parameter. The heat rate weighting factors for the key parameters are available as industry averages in the Electric Power Research Institute (EPRI) "Heat Rate Accounting Manual," or unit specific weighting factors can be generated for improved accuracy. In general, with respect to a particular key parameter, a positive permissive value indicates that cleaning the furnace would improve the efficiency of the plant, while a negative permissive value indicates that cleaning would hurt the plant efficiency.

Next, step 22 adds the permissive values determined in step 20. The sum of the permissive values provides an overall permissive value. The various individual permissive values could either be positive or negative. The process 10 then proceeds to decision step 24 which determines whether or not to clean the furnace. In particular, step 24 determines whether the overall permissive value calculated in step 22 is positive or negative. If the overall permissive value is negative, the furnace is not cleaned, as indicated in to step 26. At step 27, the process 10 waits for a time period pre-selected, for example, by the operator. After this time period, the process 10 returns to step 14 to retrieve a new set of current values of the key parameters and then repeats the aforementioned steps 18, 20, 22, and 24.

If the overall permissive value is positive, as determined in step 24, then the furnace is to be cleaned. If desired, the process 10 then proceeds to step 28 which determines which local areas or regions of the furnace are to be cleaned. Such determination can be made through the use of furnace cleanliness sensors distributed in various regions of the furnace. Examples of such sensors include heat flux and emissivity sensors.

After the furnace has been cleaned, the process 10 terminates at step 30. After a time period selected by the operator, or automatically by the system, the process 10 may again initiate at step 12.

FIG. 2 shows an example of the application of the process 10 in an Excel spreadsheet which performs the heat rate-based calculations in accordance with the invention. In it, the "Reading" (live current value) is compared to a "Setpoint" value, and a "Weight Factor" is multiplied by the difference to get a "Permissive" value for that parameter. The superheat (or main) steam temperature is measured at two locations (identified as North and South in this particular example), providing an average superheat steam temperature of 997.2° F. The setpoint value for the superheat steam temperature is 995° F. and the weight factor is 1.4. Hence, the permissive value is $(1.4)\times(997.2-995)=3.1$. Similar analysis is made for the reheat steam temperature, providing a permissive value of −20.5

The total attemperation superheat spray flow injected into the two superheat regions is 237.1 Klb/hr and the total attemperation reheat spray flow is 36.1. Thus, employing the weight factors and setpoint values shown in FIG. 2, the permissive values for the attemperation superheat spray flow and reheat spray flow are 55.9 and 56.2, respectively.

Then, upon adding the permissive values together, the overall permissive value is 94.6. The overall decision as to whether the optimization process wants the furnace to be cleaned is based on whether the overall permissive value is positive, as in the present example. Thus, the overall heat rate permissive is 1, indicating that the furnace is to be cleaned.

As an example of how this calculation and subsequent decisions are of value to the customer, note how the current reheat temperature is actually well below the setpoint value, that is, 980° F. versus 995° F. Thus, furnace cleaning actually hurts this parameter, but helps the rest. It is not uncommon to have boilers that have an excessive reheat temperature but struggle to make the setpoint superheat temperature, or vice versa.

In some implementations, the optional Operational Permissive Parameters in FIG. 2 are used as configurable comparisons of certain parameters to ensure that furnace cleaning doesn't occur outside acceptable ranges. If the current value of one of these parameters is greater than its setpoint value, the permissive value for that parameter is assigned "1". If the current value is less than the setpoint value, the permissive value is "−1". In the present example, the current values of the load and the two furnace exit gas temperatures (FEGT) are all above their setpoint values. Thus, their permissive values are all set to "1" indicating that furnace cleaning will improve the efficiency of the boiler with respect to these parameters. Of course, adding these permissive values provides a positive number, and therefore the overall operational permissive value is set to "1".

Since both the overall heat rate permissive and the overall operational permissive are positive, then the overall system permissive value is also set to "1". That is, based on the current operational data of the furnace, the optimization process in accordance with the invention determines that the furnace is to be cleaned, since doing so will improve the overall efficiency of the plant.

It is therefore intended that the foregoing detailed description be regarded as illustrative rather than limiting, and that it be understood that it is the following claims, including all equivalents, that are intended to define the spirit and scope of this invention.

What is claimed is:

1. A method for determining when a furnace is to be cleaned, comprising:

receiving current values of a plurality of parameters associated with the performance of the furnace;

comparing the current values of the parameters with respective setpoint values of the parameters, the comparing considering how the deviation of the current values from the setpoint values affects the thermal efficiency of the steam cycle of the furnace, the comparing including determining the difference between the current values of the plurality of parameters with the respective setpoint values and further including determining a permissive value for each of the plurality of parameters, each permissive value being the product of a respective difference and a corresponding weight factor; and determining whether to clean the furnace based on the comparison between the current values and setpoint values of the parameters.

2. The method of claim 1 wherein a positive permissive value indicates that cleaning the furnace would increase the efficiency of the thermal cycle, and a negative permissive value indicates that cleaning the furnace would decrease the efficiency of the thermal cycle.

3. The method of claim 1 further comprising adding the permissive values, wherein the determining whether to clean decides to clean the furnace if the sum of the permissive values is positive.

4. The method of claim 1 wherein the plurality of parameters includes a superheat steam temperature.

5. The method of claim 4 wherein the plurality of parameters includes a reheat temperature.

6. The method of claim 5 wherein the plurality parameters includes an amount of attemperation superheat spray flow being injected into the superheat steam to control the superheat steam temperature and an amount of attemperation reheat spray flow being injected into the reheat steam to control the reheat temperature.

7. A method for determining when a furnace is to be cleaned, comprising:

receiving current values of a plurality of parameters associated with the performance of the furnace;

subtracting respective setpoint values from the current values of the plurality of parameters;

multiplying the difference from the subtracting by a weight factor to determine a permissive value for each parameter;

adding the permissive values to determine an overall permissive value;

if the overall permissive value is positive, determining that the furnace is to be cleaned; and if the overall permissive value is negative, determining that the furnace is not to be cleaned.

8. A method for determining when a furnace is to be cleaned, comprising:

measuring with at least one sensor a parameter selected from the group consisting of attemperator spray flow, reheat temperature, and superheat temperature;

determining the difference between the current value of the parameter with a respective setpoint value;

determining a permissive value for the parameter, the permissive value being the product of the respective difference and a corresponding weight factor; and optimizing the cleaning of the furnace with a controller on the basis of the of the permissive value.

* * * * *

UNITED STATES PATENT AND TRADEMARK OFFICE

CERTIFICATE OF CORRECTION

PATENT NO. : 6,928,937 B2
DATED : August 16, 2005
INVENTOR(S) : Joel H. Booher

It is certified that error appears in the above-identified patent and that said Letters Patent is hereby corrected as shown below:

Column 6,
Line 48, after "the basis" delete "of the" (first occurrence).

Signed and Sealed this

Twenty-fifth Day of April, 2006

JON W. DUDAS
*Director of the United States Patent and Trademark Office*